US009618232B2

(12) United States Patent
Brown

(10) Patent No.: US 9,618,232 B2
(45) Date of Patent: Apr. 11, 2017

(54) CONVERSION OF SINGLE-PASS BOILER TO MULTI-PASS OPERATION

(71) Applicant: Theodore S. Brown, Harmony, ME (US)

(72) Inventor: Theodore S. Brown, Harmony, ME (US)

( * ) Notice: Subject to any disclaimer, the term of this patent is extended or adjusted under 35 U.S.C. 154(b) by 782 days.

(21) Appl. No.: 13/864,216

(22) Filed: Apr. 16, 2013

(65) Prior Publication Data

US 2014/0305385 A1 Oct. 16, 2014

(51) Int. Cl.

| | |
|---|---|
| ***F24H 9/00*** | (2006.01) |
| ***F24H 1/30*** | (2006.01) |
| ***F24H 1/32*** | (2006.01) |

(52) U.S. Cl.

CPC ..... *F24H 9/0026* (2013.01); *F24H 1/32* (2013.01); *F24H 1/30* (2013.01); *F24H 9/001* (2013.01)

(58) Field of Classification Search

CPC ..... F24H 9/001; F24H 9/0026; F24H 1/30; F24H 1/32

USPC ..... 122/18.31, 18.3, 18.4, 18.1, 44.2, 50

See application file for complete search history.

(56) References Cited

U.S. PATENT DOCUMENTS

| | | | | |
|---|---|---|---|---|
| 4,291,649 A | | 9/1981 | Boeder | |
| 4,346,901 A | * | 8/1982 | Booth | F41J 2/02 219/548 |
| 4,401,101 A | * | 8/1983 | Lunde | F24D 11/002 122/155.2 |
| 4,671,212 A | * | 6/1987 | Smith | F24H 1/41 122/155.2 |
| 5,109,806 A | * | 5/1992 | Duggan | F24H 1/32 122/135.2 |
| 5,311,843 A | | 5/1994 | Stuart | |
| 5,787,846 A | | 8/1998 | Schimmeyer | |
| 5,832,846 A | | 11/1998 | Mankowski et al. | |
| 6,257,155 B1 | | 7/2001 | Greene | |
| 6,564,756 B1 | | 5/2003 | Rayes | |
| 6,672,255 B1 | | 1/2004 | Zayas | |
| 6,748,880 B2 | | 6/2004 | DeSellem | |

(Continued)

OTHER PUBLICATIONS

"MPC High Efficiency Cast Iron Multi-Pass Commercial Water Boiler", Burnham Commercial Boilers; Lancaster, PA; no date.

(Continued)

*Primary Examiner* — Alissa Tompkins
*Assistant Examiner* — Benjamin W Johnson
(74) *Attorney, Agent, or Firm* — W. F. Fasse

(57) ABSTRACT

Modifications convert an existing single-pass boiler to operate with a multi-pass combustion gas flow through the flue passages of the heat exchanger of the boiler. A diverting target wall is arranged partway along the length of the original combustion chamber, and an upper draft diverter is arranged in a flue collector chamber above the flue passages, to divert some or all of the combustion gas into a multi-pass flow pattern through several flue passages of the heat exchanger in series. The modifications may further include changing the nozzle oil delivery rate and cone angle, the oil supply pressure, the draft conditions, and others. Heat extraction from the hot combustion gas to the boiler water is increased, exhaust gas temperature is decreased, and overall efficiency is increased, to result in a fuel and cost savings.

20 Claims, 4 Drawing Sheets

(56) References Cited

U.S. PATENT DOCUMENTS

| | | | | |
|---|---|---|---|---|
| 7,137,360 | B1 * | 11/2006 | Zorzit | F22B 13/04 122/235.11 |
| 7,194,963 | B2 | 3/2007 | Ganeshan | |
| 7,290,503 | B2 | 11/2007 | Missoum et al. | |
| 7,311,064 | B2 | 12/2007 | Schimmeyer | |
| 7,669,535 | B2 | 3/2010 | Moskwa et al. | |
| 7,900,589 | B2 | 3/2011 | Gordon et al. | |

OTHER PUBLICATIONS

"MPC (Multi-Pass Commercial)"; http://www.burnhamcommercial.com/products/high-efficiency/mpc/; accessed and printed Sep. 13, 2012.

* cited by examiner

CONVERSION OF SINGLE-PASS BOILER TO MULTI-PASS OPERATION

FIELD OF THE INVENTION

The present invention relates to the general field of hot water boilers, and especially oil-fired and gas-fired boilers, with respect to the servicing and operation of existing boilers. Particularly, the present invention relates to a method and a conversion kit for converting an existing single-pass boiler design to multi-pass operation, as well as a boiler converted in such a manner.

BACKGROUND INFORMATION

Many different configurations and constructions of boilers have become known for burning a fuel to produce heat and transferring a portion of the heat to water, for heating the water in order to produce hot water or steam. The fuel may be wood, coal, natural gas, propane, or No. 2 heating oil, for example. Known boilers are constructed of cast iron sections that are connected together by pipe nipples and bolts or threaded rods, plane steel plate members that are welded together, or stainless steel plate members that are welded or brazed together, for example. Of particular interest in the present application are especially sectional cast iron boilers fired by heating oil for producing hot water, but other boiler types are also pertinent. The hot boiler water is used for domestic or commercial space heating, commercial or industrial process heating, and/or for the further production of hot domestic or commercial tap water via further heat exchange from the hot boiler water to potable tap water through an additional heat exchanger. Nonetheless, the present application is not limited to such boilers, but rather may also apply to other constructions and uses of known boilers.

A relatively old-fashioned conventional cast iron sectional boiler is schematically illustrated in FIG. 1 of the drawings of the present application. The conventional cast iron sectional boiler 1 includes a fire box or combustion chamber 5, an oil burner unit 8 and a heat exchanger 10 that forms a water-filled jacket 17 above and sometimes behind and on the sides of the combustion chamber 5, and sometimes also under the combustion chamber. The heat exchanger 10 is formed from several cast iron sections including a front section 10A, a back or rear section 10C and one or more intermediate sections 10B1, 10B2, etc. The front section 10A and the rear section 10C each have a specialized individual configuration, but the intermediate sections 10B1 and 10B2 all have the same standardized configuration, and more of these intermediate sections can be provided in order to construct a larger boiler providing a greater heating capacity. Combustion gas flue passages 11 are formed respectively between successive ones of the boiler sections. Namely, in the four-section boiler 1 shown in FIG. 1, a first flue passage 11A is formed between the sections 10A and 10B1, a second flue passage 11B is formed between the sections 10B1 and 10B2, and a third flue passage 11C is formed between the sections 10B2 and 10C. The cast iron sections are typically formed with heat exchange pins, vanes, or fins 18 provided on the surfaces thereof bounding the flue passages 11, in order to increase the surface area of the heat exchanger available for heat exchange between the hot flue gases 20 and the cast iron material, and ultimately to the water 17 in the heat exchanger 10.

The burner unit 8 includes a motor driving an oil pump and an air blower, an oil nozzle 9 through which oil is ejected under pressure from the pump, an electric ignition system for igniting the oil ejected from the nozzle, and an electronic control system. The nozzle 9 sprays the high pressure oil in a cone pattern of very fine atomized oil droplets, mixed into a flow of air provided by the air blower. The atomized mist of oil droplets is ignited to produce a combustion flame 19 in the combustion chamber 5. To protect the cast iron boiler jacket or body from the extreme high temperature of the combustion flame 19, and to keep the combustion hot (i.e. insulated from the cool water on the other side of the cast iron combustion chamber wall), the back wall of the combustion chamber 5 is typically covered or lined with a target wall 6, for example of refractory ceramic fiber (RCF) board such as Kaowool™ or Ceraboard™ RCF board. Similarly, the bottom floor and/or side walls of the combustion chamber 5 are typically covered or lined with an insulation blanket 7 such as a flexible blanket of refractory ceramic fiber (RCF) such as Kaowool™ or Ceraboard™ blanket.

Under proper combustion conditions, the oil should be completely combusted within the combustion chamber 5, to produce hot flue gas 20, which passes upwardly through the heat exchanger, namely a first hot gas flow 20A passes upwardly through the first flue passage 11A, a second hot gas flow 20B flows upwardly through the second flue passage 11B, and a third hot gas flow 20C passes upwardly through the third flue passage 11C. In the flue passages, the hot gas flows give off some of their heat to the heat exchange pins 18 and the other surfaces of the cast iron sections 10A, 10B1, 10B2 and 10C, and thus to the water 17 contained in the sections, thereby heating the water. The somewhat cooler flue gases are then accumulated or collected in a flue collector chamber or exhaust manifold chamber 12 above the heat exchanger 10, and from there are directed out of the breech or flue outlet 14 of the boiler 1 as exhaust flue gas 21. The flue collector chamber or exhaust manifold chamber 12 is formed and enclosed within a flue exhaust collector hood or clean out cover 13 mounted on top of the heat exchanger 10. Also, to reduce heat losses from the boiler to the surrounding ambient environment, the cast iron sections 10 forming the boiler body are surrounded by a layer of insulation 15 such as fiberglass wool, which is further covered or encased in outer cover panels 16, for example of painted sheet metal.

To achieve maximum efficiency, it is of course desired to extract as much heat as possible from the hot flue gas 20 and transfer it to the water 17 in the heat exchanger 10, thereby cooling the hot flue gas 20 as much as possible, and thus achieving the lowest possible gross stack temperature or breech temperature of the exhaust flue gas 21 at the breech 14. However, it is conventionally taught that the temperature of the exhaust flue gas 21 at the breech of the boiler must remain above at least about 340° F. to avoid problems caused by condensation of water vapor and sulfur components out of the exhaust flue gas 21 in the chimney flue or the like. Namely, the hot flue gas 20 includes water vapor, sulfur, and other components of the heating oil and the combustion air provided through the oil burner unit 8, and at breech temperatures below about 340° F. these components can begin to condense in the chimney flue and form a corrosive acidic liquid condensate that can cause significant corrosive damage and failure of the flue and the cast iron boiler if this condensate drips back down into the boiler. Also, colder spots in the boiler might suffer condensation directly in the boiler. The actual dew point or condensing temperature of the oil combustion vapor is about 117° F., so it must be ensured that the combustion exhaust gases remain above about 120° F. everywhere in the boiler and through the entire length of the exhaust system such as a chimney, until exiting at the top of the chimney. To ensure a chimney top temperature above 120° F., it is typically recommended to maintain a breech temperature at the breech outlet of the boiler above about 335° F. or 340° F.

However, due to inherent inefficiencies in the conventional single-pass sectional boiler 1 shown in FIG. 1, such boilers generally do not achieve such low breech temperatures that condensation problems arise. To the contrary, such boilers typically exhibit an extremely high breech temperature, for example gross breech temperatures in a range from 400° F. to 500° F. or even higher. As a result, much of the heat value of the input heating oil "goes up the chimney" in the form of unnecessarily and excessively hot exhaust flue gas 21, because of less than optimal heat transfer from the hot flue gas 20 to the water 17 through the heat exchanger 10. The first major cause of such inefficiency of the heat transfer is the typical conventional "single-pass" design of the heat exchanger. Namely, the hot flue gas 20 makes only a single pass through the heat exchanger 10. The hot flue gas 20 divides into three hot gas flows 20A, 20B and 20C, which each respectively pass a single time upwardly through a single flue passage 11A, 11B or 11C respectively, before being collected in the manifold chamber 12 and being exhausted as flue gas 21 out through the breech 14. Thus, the hot flue gas 20 has only a relatively short distance of travel through the heat exchanger 10, and thus only a relatively short residence time in the heat exchanger 10, during which the heat transfer can take place.

Secondly, the heat exchange is also inefficient due to the direction of flow of the hot gas 20 relative to the direction of flow and the temperature stratification of the water 17 in the heat exchanger 10. The hottest water 17 naturally convects to the top of the heat exchanger 10. Also, the cool water returns to the boiler (e.g. from space heating radiators or the like) to a boiler water return inlet 22 connected to the bottom of the boiler water jacket, and hot water is tapped from the boiler through a hot boiler water supply outlet 23 connected to the top of the boiler water jacket. Thus, the flow of water is generally upward through the boiler and especially the heat exchanger 10, with cooler water toward the bottom and hotter water toward the top. The flow direction of the hot gas 20 is also upward through the heat exchanger 10. The hot gas 20 cools as it passes upwardly through the heat exchange passages, and the water 17 heats as it passes upwardly though each heat exchanger section. As a result, the gas 20 near the top of each heat exchanger passage is at its coolest temperature, but the water 17 near the top of the water jacket is at its hottest temperature. The rate of heat transfer between this coolest gas and hottest water is thus relatively low and inefficient. Basically, the heat exchanger is configured as a parallel flow heat exchanger, with both the primary hot fluid (hot gas 20) and the secondary fluid to be heated (water 17) flowing in parallel in the same direction. It is known that such a parallel flow heat exchange configuration is less efficient than a counter-flow heat exchange configuration, in which the two fluids flow generally in opposite directions, for example that the hottest flue gas 20 would be adjacent to the hottest water 17 while the coolest flue gas would be adjacent to the coolest water.

To improve the heat transfer efficiency and thus the overall efficiency, newer boilers with a multi-pass configuration have been designed. In such multi-pass boilers, the flue passages are configured so that the hot flue gas must flow in a serpentine back-and-forth fashion through the heat exchanger, through several adjacent flue passages in series one after another rather than in parallel as in the single-pass boiler described above. In such multi-pass boilers, for example boilers manufactured by Burnham and by Biasi, the flue gases typically flow horizontally back-and-forth, namely from the front to the rear of the boiler in the combustion chamber, and then forwardly through one set of flue passages, and then again toward the rear through another set of flue passages, before being exhausted out through the breech. Such boilers are typically called a three-pass boiler, although there are actually only two passes through heat exchanger flue passages and one pass through the combustion chamber. Such multi-pass sectional boilers can be expanded by adding additional sections as described above, to increase the total length of the boiler. While the flue passages thereby get longer, the boiler remains a three-pass boiler, i.e. no additional back-and-forth passes are provided. Nonetheless, such boilers exhibit a significantly higher AFUE (Annual Fuel Utilization Efficiency) in comparison to the older technology single-pass boilers described above and illustrated in FIG. 1.

It has also become known to construct a boiler, particularly a gas fired boiler, to include baffles in the flue passages within each cast iron section to create a serpentine flow passage through the boiler, for example as disclosed in U.S. Pat. No. 5,109,806 (Duggan et al.). While such a boiler only provides a single pass through each boiler section, and only a single pass of the hot flue gas through the heat exchanger, the passage through each section is longer due to the serpentine flow pattern created by the baffles. As another improvement, it is known to provide fins within the passages of heat exchanger sections of a boiler, in order to redirect and distribute the hot gas flow from the combustion chamber into each respective flue passage segment in the boiler, for example as disclosed in U.S. Pat. No. 7,669,535 (Moskwa et al.). It is also known from U.S. Pat. No. 5,311,843 (Stuart) to arrange water flow diverter baffles selectively in the water flow header of a gas-fired water heater in order to achieve a single-pass or multi-pass flow of the water through the water passages of the heat exchanger.

While the above improved features of new technology boilers and water heaters achieve an improved efficiency in comparison to the operating efficiency of existing older technology single-pass boilers, that is unfortunately not directly helpful to the owners of an older single-pass sectional boiler that is otherwise still serviceable and operating well, except for a relatively low efficiency. In view of today's ever-increasing costs of heating oil, there is a strong urge to achieve the greatest efficiency of a heating boiler. The owner of such an older inefficient but serviceable boiler is thus faced with the dilemma of continuing to operate the old inefficient boiler with a higher ongoing operating cost due to the higher consumption of heating oil, or to pay a substantial initial capital cost to replace the old inefficient boiler with a newer more-efficient multi-pass boiler in hopes of achieving a payback of the capital expense over the course of several years in view of reduced operating expenses due to reduced heating oil consumption. Especially in view of the present high cost of heating oil, there is a great demand for avoiding this dilemma, for example by improving the efficiency of the existing older single-pass boiler, at a relatively low cost, without having to completely replace the existing boiler with a new multi-pass boiler. None of the prior art has taught or successfully achieved how to solve or avoid the above dilemma.

Another approach to reduce fuel consumption and slightly increase heat transfer efficiency in an existing boiler is to derate or underfire the burner unit at a lower oil supply rate than the specified burn rate for the boiler. This can usually be accomplished simply by exchanging the burner nozzle with a smaller or lower rated nozzle, e.g. having a smaller nozzle orifice. Thus, the burner will inject and burn oil at a lower rate (e.g. gallons per hour), and also produce less combustion heat energy than the boiler is rated for. The heat exchanger thus becomes effectively bigger in proportion to the produced heat energy, and therefore the heat exchange efficiency increases slightly. This approach is especially applicable if the boiler capacity was originally oversized for the heating demand, or if upgrades to the building's insulation, windows, doors, air-sealing efforts, or the like have reduced the heating demand of the building below the original design heat load. In such cases, derating the oil burner reduces the heat output capacity of the overall boiler system to better match the required heat load, while also achieving slightly improved efficiency. However, such derating of the burner does nothing to address the inherent inefficiency of a single-pass up-flow heat exchanger arrangement of the typical conventional sectional cast iron boiler as discussed above in connection with FIG. 1. The combustion gases still flow too-rapidly through a single pass through the heat exchanger, and much of the available heat energy is simply wasted in the exhaust gas exiting the boiler at a higher temperature than necessary. It would still be desirable to further improve the heat transfer efficiency in order to further reduce the boiler breech temperature and stack temperature by extracting more heat from the hot flue gases and transferring that heat to the boiler water.

SUMMARY OF THE INVENTION

In view of the above, it is an object of the present invention to improve the efficiency of an existing single-pass boiler by converting it to multi-pass operation to achieve multiple passes of the hot flue gas through successive flue passages of the heat exchanger in series one after another. It is a further object of the present invention to provide a retrofit kit of relatively inexpensive components that can be easily installed in an existing single pass boiler for converting it to multi-pass flue gas flow operation. It is a further object of the present invention to provide additional modifications or adjustments of the boiler that are necessary or desirable for the conversion from single-pass to multi-pass operation. Another object of the invention is to provide a method of carrying out such a conversion of a single-pass boiler to multi-pass flue gas flow operation. Still further, another object of the invention is to provide a conversion or modification of the gas flow through the heat exchange passages to achieve at least a partial or gross counter-flow of the hot gas and the water opposing one another through the heat exchanger of a boiler. The invention further aims to avoid or overcome the disadvantages of the prior art, and to achieve additional advantages, as apparent from the present specification. The attainment of these objects is, however, not a required limitation of the claimed invention.

The above objects have been achieved according to the invention by installing a draft diverting target wall in the combustion chamber, and an upper draft diverter in the upper flue collector chamber above the heat exchanger, of an existing single-pass boiler that has at least three flue passages parallel to one another in the heat exchanger originally providing a single-pass flow of flue gas through the flue passages. The draft diverting target wall and the upper draft diverter are effective to divert the hot flue gases to flow in series through the flue passages in a multi-pass flow configuration. The diverter components are preferably made of refractory ceramic fiber (RCF) board. Other adjustments are preferably also made to the boiler, e.g. the burner nozzle may be derated to a lower oil firing rate and changed to a narrower injection cone angle.

One aspect of the invention relates to a combination of any selected ones of the modifications disclosed herein to convert an existing single-pass boiler to multi-pass flue gas flow through the heat exchanger thereof. Another aspect of the invention relates to a kit of parts for carrying out any of the modifications disclosed herein. For example, such a kit can include pre-cut components of RCF board and RCF blanket, such as the diverting target wall, the smaller-size floor insulation blanket, and the upper draft diverter components, appropriately sized and fitted for installation in a specific model of boiler. Alternatively, such a kit can include blank uncut sheets of RCF board and/or RCF blanket along with instructions and/or templates for cutting the ceramic fiber material into the appropriate shapes to make the required draft diverting components. A further aspect of the invention relates to a method including steps for performing any or all of the modifications disclosed herein to convert an existing single-pass boiler to multi-pass operation. Still another aspect of the present invention relates to a boiler that is originally constructed as a single-pass boiler, but that further includes modifications as disclosed herein to convert this boiler to multi-pass operation without requiring permanent structural changes of the heat exchanger or of the boiler itself.

BRIEF DESCRIPTION OF THE DRAWINGS

In order that the invention may be clearly understood, it will now be explained in further detail in connection with example embodiments thereof, with reference to the accompanying drawings, wherein.

DETAILED DESCRIPTION OF PREFERRED EXAMPLE EMBODIMENTS AND THE BEST MODE OF THE INVENTION

Figure 1:
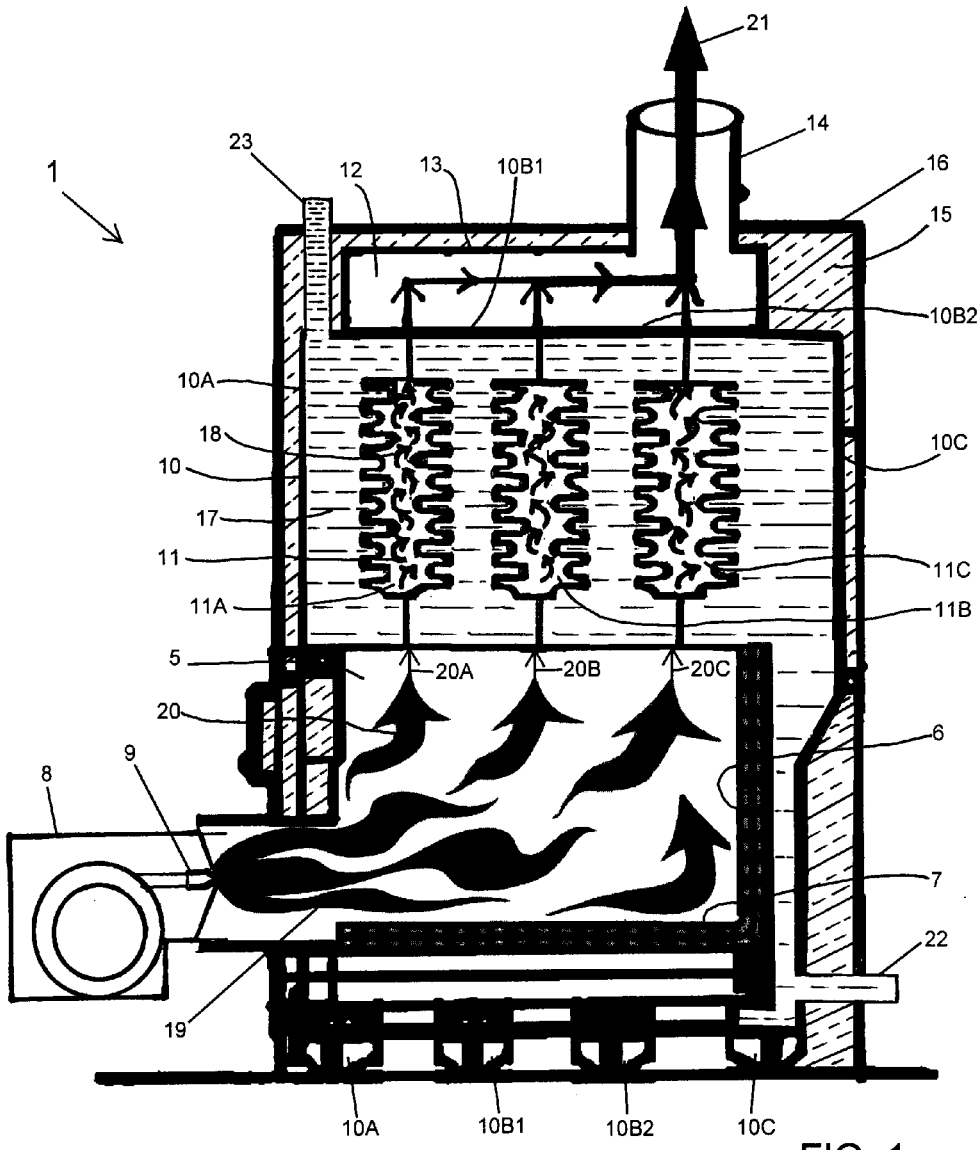
FIG. 1 PRIOR ART
FIG. 1 is a schematic sectional side view of a conventional single-pass cast iron sectional boiler with four cast iron sections forming three flue passages through the heat exchanger of the boiler.
Figure 2:
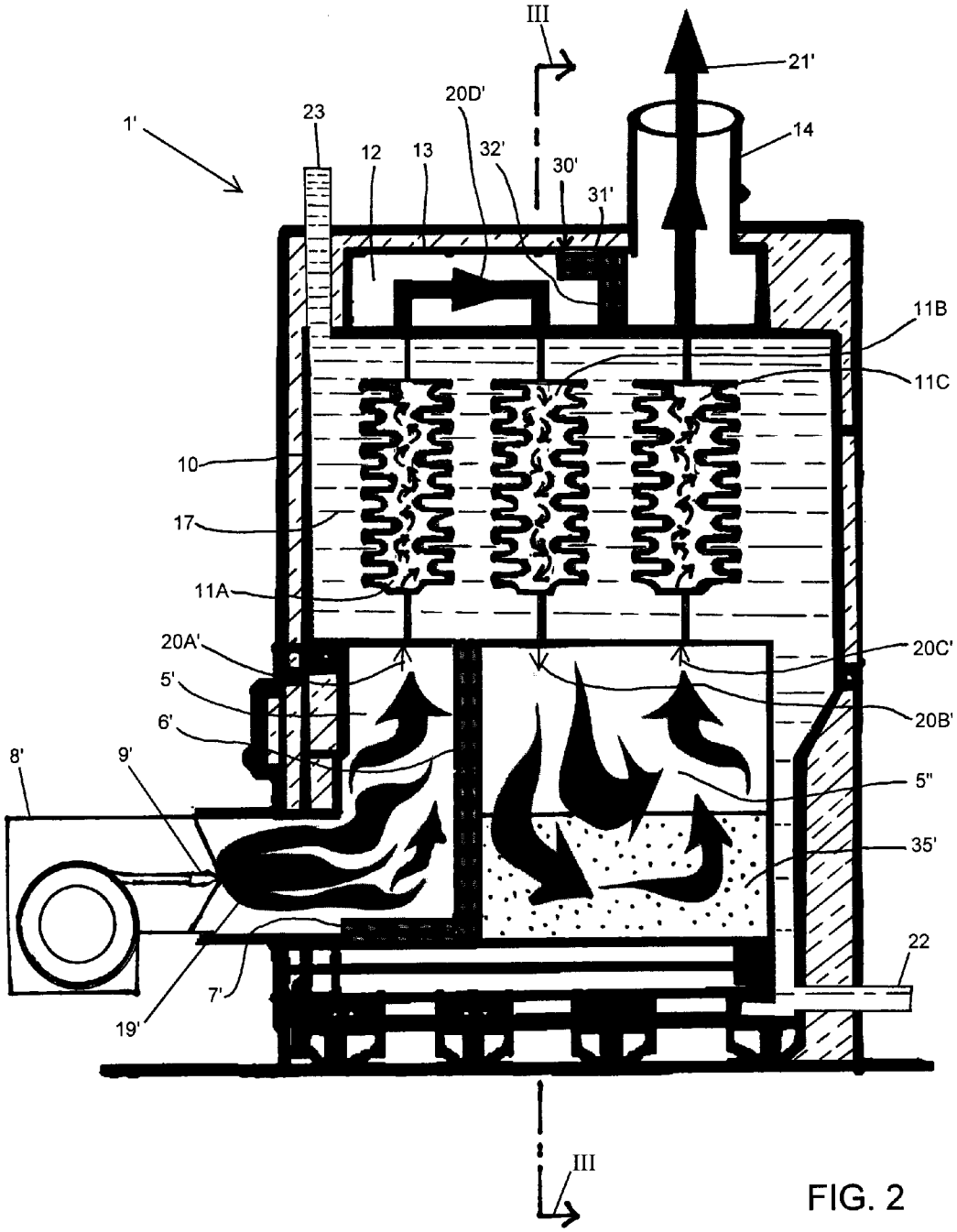
FIG. 2 is a schematic sectional side view of the four-section cast iron boiler of FIG. 1, modified according to the invention to be converted from single-pass to multi-pass flue gas flow through the flue passages of the heat exchanger.

The conventional single-pass cast iron sectional boiler shown schematically in FIG. 1 has been discussed above. That conventional boiler 1 will be retrofitted with additional components and modifications according to an embodiment of the invention to produce the boiler 1' with the modified inventive configuration as shown in FIG. 2. Most of the components and features of the inventive modified boiler 1' correspond to the conventional boiler 1, and a description thereof will not be repeated. The above description applies here as well. The same reference numbers are used for the inventive boiler 1' in FIG. 2 as in the conventional boiler 1 in FIG. 1. Modified components are labeled with the same reference number supplemented by a prime mark (') or a double prime mark ("). Additional components or features are identified by additional reference numbers in FIG. 2.

Generally, the boiler 1 has been modified by the installation of a draft diverter system to achieve top efficiency from the basic boiler structure, by diverting the draft (and making additional modifications) to achieve a multi-pass gas flow through the heat exchanger 10 in the modified boiler 1', rather than the single-pass flow of hot flue gas through the heat exchanger 10 in the conventional boiler 1. As is apparent by comparing FIG. 1 and FIG. 2, the draft diverter system and modifications according to the invention are rather simple, do not require substantial permanent structural modifications of the boiler, are easy to install and maintain, and can be achieved using economical off-the-shelf available components with minor modifications. The details thereof will be explained below. Despite the relative simplicity and low cost of the inventive draft diverter system, it has been determined through experimental installations, that significant efficiency improvements and thus fuel savings can be achieved by converting a conventional single-pass boiler 1 to a modified boiler configuration 1' as shown in FIG. 2.

Figure 3:
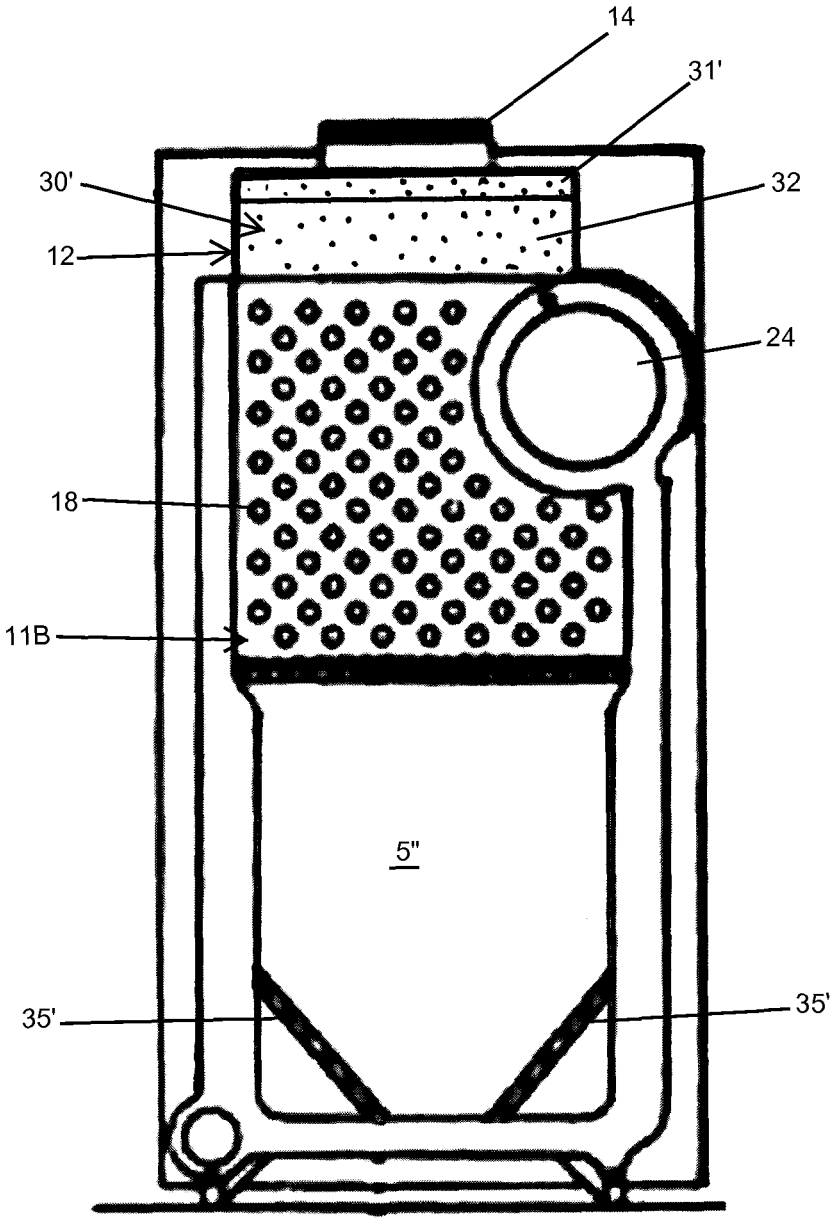
FIG. 3 is a schematic sectional front view of the inventive modified boiler according to FIG. 2, taken along the section line III-Ill in FIG. 2.

The most significant modification in the inventive system and method basically involves moving the combustion target wall from the rear wall of the boiler combustion chamber to a position within and partway along the length of the original combustion chamber at a location below one of the boiler sections, so as to divert all (or at least a portion) of the combustion gases upward, as well as installing an additional upper draft diverter 30' in the flue collector chamber or exhaust manifold chamber 12 so as to divert all (or at least a portion) of the flue gases downwardly through a next flue passage. More particularly, the details of this modification are as follows. Comparing FIGS. 1 and 2, it can be seen that the original rear target wall 6 has been removed and replaced with a diverting target wall 6' at a location directly below the second section 1061 of the boiler heat exchanger 10. Alternatively, the original existing rear target wall 6 could simply be repositioned to provide the diverting target wall 6', but that may not be possible or advisable if the rear target wall 6 is brittle, damaged or deteriorating. Also, it may be necessary to cut and reshape the rear target wall 6 to form the diverting target wall 6'. Otherwise, the diverting target wall 6' is preferably fabricated from a new sheet of refractory ceramic fiber board such as Kaowool™ or Ceraboard™ RCF or the like. Generally, the same material of any conventional target wall can be used to fabricate the diverting target wall 6'. It is simply necessary to cut the appropriate perimeter outline to achieve a substantial fitting and sealing contact between the perimeter edges of the diverting target wall 6' and the interior walls of the combustion chamber. Furthermore, depending on the configuration of the cast iron sections and the interior of the combustion chamber of the boiler, it may be necessary to notch edges of the RCF board to engage or fit onto fingers, tabs, fins or pins protruding from the inner wall of the combustion chamber. Preferably, if the bottom of the heat exchanger 10 has pins or fins protruding downwardly, the upper edge of the diverting target wall 6' is notched to firmly engage onto those pins, so as to hold the top of the diverting target wall 6' in its proper position. Further preferably, as seen in FIG. 2 and the front sectional view of FIG. 3, two supports or stops 35' are also cut from RCF board material to fit in the axial or lengthwise space between the diverting target wall 6' and the rear wall of the boiler's combustion chamber so as to brace and support the bottom end of the diverting target wall 6' in its proper position. The two supports or stops 35' are preferably cut to fit, and then wedged or braced diagonally, e.g. at approximately a 45° angle, into bottom corner areas of the combustion chamber of the boiler as shown in FIG. 3. Then the upper edge of the diverting target wall 6' (notched as described above) is engaged in position on the pins or fins at the proper location on the upper wall of the combustion chamber (bottom of the heat exchanger). Then the bottom of the diverting target wall 6' is pivoted rearwardly against the previously positioned stops 35', to achieve the positioning and arrangement shown in FIG. 2. Then, further preferably, an additional small insulation blanket 7' is placed on the floor and up onto the walls of the combustion chamber in front of the diverting target wall 6', which further helps to hold the diverting target wall 6' in position, and also serves its usual function of protecting the floor of the combustion chamber from the intense heat of the combustion flame 19' and keeping the combustion hot and clean.

While the RCF board is easy to cut with a typical saw or the like and is also easy to position and secure in the boiler spaces, the fabricator and installer should observe all health risk warnings regarding the handling or cutting of fiberglass, silica, other ceramic or other fibrous materials, as set forth by the material manufacturer in an applicable material safety data sheet or the like. For example, the fabricator and installer should wear gloves and a breathing respirator to avoid possible injury by the silica or fibrous materials.

The above described arrangement of the diverting target wall 6' serves at least two functions. First, it diverts all (or at least a portion) of the hot combustion gases as a first diverted hot flue gas flow 20A' upwardly through the first flue passage 11A as shown in FIG. 2. Secondly, the diverting target wall 6' divides the entire volume or space of the original combustion chamber 5 into a smaller reduced-volume combustion chamber 5' and an additional heat exchange chamber 5".

Another aspect of the modifications of the boiler to achieve the multi-pass draft diversion, is the installation of the upper draft diverter 30' in the flue collector chamber 12 within the flue exhaust collector hood 13 as shown in FIG. 2. The upper draft diverter 30' includes at least a vertical diverter part 32', but may additionally include a horizontal diverter part 31' for bracing and securing the vertical part 32'. The component or components of the upper draft diverter 30' are preferably cut from a refractory ceramic fiber (RCF) board similarly as the diverting target wall 6' discussed above. It is simply necessary to cut the perimeter shape of the upper draft diverter components 31' and 32' to the available space within the flue exhaust collector hood 13. This space is easily accessed by removing the flue exhaust collector hood or at least a clean out cover provided thereon. The uncovered opening may be at the top, the side or the front of the boiler 1'. In any case, the pre-cut parts 31' and 32' are simply slid into place and braced against the top of the heat exchanger 10 and the inner side of the top cover or collector hood 13. Alternatively, depending on the configuration of the clean-out hole and the clean-out cover, it may be suitable to position the upper draft diverter in place, and then secure the clean-out cover on top of it, whereby the clean-out cover clamps and holds the upper draft diverter in place. Just as described for the draft diverting target wall 6', this may involve notching the edges of the components of the upper draft diverter 30' to fit onto fins, pins, or other protrusions of the adjoining components inside the boiler. If necessary to achieve a secure placement of the components, it is also possible to fix or secure one or more edges of the draft diverting target wall 6' and/or the upper draft diverter 30' with refractory cement, furnace cement, or the like. The seal around the edges of the diverting target wall 6' and the upper draft diverter 30' does not need to be absolutely gas-tight, although it is preferably nearly or completely so.

On the other hand, in certain applications it may be necessary or desirable to purposely allow some bypassing of the multi-pass flue diversion, if the single flue passage 11A, 11B or 11C does not provide sufficient cross-sectional area to flow the entire combustion gas stream therethrough while maintaining the required overfire draft and breech draft values. In such a situation, a bypass hole is purposely formed in the diverting target wall 6' and in the upper draft diverter 30', or bypass leakage gaps are purposely left around the perimeter thereof, so that some of the combustion gases will still undergo a single-pass flow rather than a multi-pass flow through the heat exchanger 10. Furthermore, by allowing some bypass flow through the diverters as described above, it is possible to adjust the exhaust stack temperature as required to achieve the desired temperature value to avoid condensation while achieving the maximum efficiency possible. Namely, the more flue gas that is allowed to bypass the diverters and thus make a single pass through the heat exchanger, the higher the stack temperature will be. The lowest stack temperature is achieved by ensuring 100% flue gas diversion into the multi-pass flow configuration.

As shown in FIG. 2, the upper draft diverter 30' (assuming the case of no bypass flow) diverts all of the hot flue gases 20A' that flowed upwardly through the first flue passage 11A, into a downward second diverted flue gas flow 20B' that flows downwardly through the second flue passage 11B. The hot flue gas then swirls through the additional heat exchanger chamber 5" in the rear part of the original combustion chamber, and then passes upwardly as a third diverted flue gas flow 20C' through the third flue passage 11C. Because the original target wall 6 was preferably removed from the rear wall of the combustion chamber, and the original floor insulation blanket 7 was preferably removed from the floor of the combustion chamber, thereby these additional wall surfaces of the inner casing of the boiler are now exposed as additional heat exchange surfaces in the chamber 5". This is especially advantageous in a boiler designed as a wet back and/or wet base boiler, in which the water filled jacket extends also along the back wall and/or under the floor of the original combustion chamber, for example as schematically illustrated in FIG. 2. Thus, additional heat transfer can take place between the hot flue gases and the water jacket along the floor and walls of the additional heat exchange chamber 5".

Thus, due to the installation of the draft diverting components 6' and 30' according to the invention as shown in FIG. 2, the hot flue gases undergo a multi-pass, and particularly a three-pass, flow through the heat exchanger 10, namely first passing upwardly through the first flue passage 11A, then passing downwardly through the second flue passage 11B, and then finally passing upwardly through the third flue passage 11C. Also, as explained above, additional heat exchange takes place in the newly formed additional heat exchange chamber 5". Thus, this configuration could almost be considered a four-pass flow. As a result of the repeated passages through the heat exchanger, the exhaust gas flow 21' exiting the breech of the inventive modified boiler 1' is at a lower exhaust gas temperature than the exhaust gas 21 exiting the conventional unmodified boiler 1 of FIG. 1. The cooler exhaust gas temperature at the breech means that more heat energy has been transferred from the hot flue gas to the water 17 in the heat exchanger or boiler water jacket. That means a higher efficiency, energy savings and cost savings are achieved by the inventive modification.

Furthermore, because a higher percentage of the energy value or energy content of the heating oil fuel is extracted, therefore a lower fuel oil input rate is required to satisfy the same heating demand. Furthermore, as mentioned above, if the original boiler was oversized for the required heat load, or if insulation upgrades or other improvements were made to the building serviced by the boiler, then it is further possible to derate the burner input. Such a derating or reduction of the fuel injection rate of the burner also goes hand-in-hand quite well with the inventive draft diversion to achieve a multi-pass gas flow. Namely, because all of the exhaust gas is forced to flow through a single flue passage (and then sequentially through each one of the flue passages individually), the flue is substantially restricted compared to the original total flue made up of the three flue passages in parallel with each other, which reduces the draft over the fire in the combustion chamber. Thus, with the draft diverting components 6' and 30' in place, it may not be possible to fire the boiler at the same fuel injection rate for which it was originally designed or rated. On the other hand, because of the increased heat transfer, it will not be necessary to fire the boiler at its original high firing rate, in order to achieve the same heat output.

Derating the burner can be achieved simply by replacing the original fuel injection nozzle 9 with a replacement nozzle 9' having a smaller orifice and a decreased fuel delivery rating, for example switching from a nozzle 9 rated for 1.25 gph or 1.1 gph, to a replacement nozzle 9' rated to deliver 0.85 gph. A typical firing rate of 1.25 gph for a four section boiler will generally be reduced to a range of about 0.85 gph to about 1 gph according to the invention. Furthermore, through testing it has been found to be advantageous and preferable to change the oil injection cone pattern or angle, especially to a narrower cone angle. This is also achieved by selecting a suitable replacement nozzle 9', for example such a nozzle providing a narrower 45° cone angle rather than the typical 80° cone angle of the original nozzle 9. It has been found that such a narrower oil spray cone pattern also achieves a narrower and tighter combustion flame 19', which strikes against the closer diverting target wall 6' and curls back from the target wall 6' in a swirling manner like backwash from a waterfall falling into a pool below the waterfall. Such a flame pattern has been found to achieve very good complete combustion of all of the oil confined within the new smaller combustion chamber 5' that is bounded or limited by the diverting target wall 6'. This helps to ensure that the combustion flame 19' is contained within the combustion chamber 5' and does not extend further upward into the colder heat exchanger 10, thereby helping to prevent or reduce sooting of the flue passage 11A. The diverting target wall 6' also becomes glowing red hot a short time after ignition of the combustion flame 19', and this further helps to maintain a very high heat environment in the smaller combustion chamber 5' which further aids in complete combustion of all of the injected oil.

Furthermore, it has found to be advantageous in some installations, to increase the oil supply pressure, as supplied by the oil pump in the burner unit 8', compared to the original pressure setting of the burner unit 8 of the unmodified boiler 1. By increasing the oil pressure and reducing the nozzle size, the oil droplets in the spray cone are more thoroughly atomized in the form of finer oil droplets. While the increased oil pressure also increases the delivery rate of oil through the nozzle, this is counterbalanced by the smaller orifice size of the nozzle. These parameters are selected as necessary to achieve the desired oil injection rate, oil droplet atomization, oil spray cone angle, and flame pattern. The overall result achieves very thorough and complete combustion of the oil, and reduced oil consumption, which contributes to the energy savings and cost savings achieved by the overall inventive modifications, system and method.

A further advantageous effect and contribution to the increased efficiency relates to the flow direction of the hot flue gases relative to the flow direction of water 17 through the boiler. As described above in connection with FIG. 1, the cooler return water enters the boiler at the return fitting 22, and flows generally upwardly and from the rear to the front of the boiler, to exit as hot water at the boiler supply fitting 23 at the top front of the boiler water jacket. Thus, the water flow is generally from the lower right to the upper left in FIG. 2, and the water becomes progressively warmer as it flows in that direction. On the other hand, the hot flue gases flow first upwardly through the first flue passage 11A, then downwardly through the second flue passage 11B, and then upwardly through the third flue passage 11C. The flue gasses become progressively cooler as they progress back-and-forth through the heat exchanger. The overall gross flow direction of the flue gases is thus from the lower left in the combustion chamber 5' to the upper right to exit the boiler through the breech or flue outlet 14. Thus, the gas flow from left to right through the boiler is contrary to the water flow from right to left through the boiler, and the gas cools down from left to right, while the water heats up from right to left. Thus, the flow of the two fluids through the heat exchanger is generally in a counter-flow arrangement, which is more efficient, because the already-cooled gas in the third flue passage 11C can give up the last of its heat to the coolest water on the right side of the boiler, while the hottest flue gas in the first flue passage 11A can give off heat to the water on the left side of the heat exchanger even though that water is already approaching its highest temperature. All of the directions (e.g. right and left) mentioned here are with reference to the illustration in FIG. 2. Such a flow pattern also helps to protect the boiler against cold water shock, because the hottest flue gases are adjacent to the hottest water, and the coldest water entering the boiler is adjacent to the cooler flue gas. There is no direct shock of the coldest water meeting the hottest gases on opposite sides of a cast iron wall at one spot within the boiler. As a further alternative option, the inventive modification may also include provision of a recirculation loop with a circulator to circulate the water through the boiler water jacket and thereby maintain the above described flow direction, or alternatively to achieve and maintain a more-even temperature throughout the boiler if that is desired for a particular application.

Further modifications according to the invention relate to the venting of the boiler or heating appliance. As mentioned above, the multi-pass draft diversion necessarily imposes a greater constriction or restriction on the flue gas flow through the heat exchanger. As a result, this tends to reduce the draft through the modified boiler 1' compared to the original operating parameters of the unmodified boiler 1. Also, because the exhaust flue gas 21' exiting a modified boiler 1' is cooler than the exhaust flue gas 21 exiting the unmodified boiler 1, the buoyancy and natural draft created by the flue gas exhausting upwardly through a conventional chimney is also correspondingly reduced. This would further tend to reduce the natural draft through the modified boiler 1'. Nonetheless, it has been found that derating the burner, i.e. reducing the oil injection rate, as discussed above may be adequate to maintain the required draft values over fire and at the breech. If not, a further recommended modification according to the invention is to install an insulated stainless steel chimney liner into the original natural draft chimney connected to the boiler, especially if it is an exterior uninsulated chimney. The insulated liner will achieve an increased natural draft, and will also maintain the exhaust gas temperature better throughout the height of the chimney, thereby further helping to avoid condensation of the oil combustion exhaust gases. Also, the stainless steel liner will be resistant to corrosion even if some minimal condensation of exhaust components occurs, for example at the top outlet of the chimney. Alternatively, another modification according to the invention involves providing a power venter, i.e. an electrically powered vent fan for direct venting of the boiler instead of natural draft venting via a chimney, or a draft induction fan to increase the draft provided by a chimney. One proposed arrangement according to the invention involves adding a powered draft inducer fan directly to the flue outlet collar of the flue outlet 14. Alternatively, the inventive modifications are especially suitable for use in connection with any conventional direct vent or power vented boiler arrangement. Such boiler arrangements have a forced draft that can be easily adjusted to achieve the required draft values. These considerations also apply for sealed combustion boiler and burner arrangements or any other boiler arrangement allowing a positive draft pressure value over the fire in the combustion chamber. When making the required adjustments, it must simply be considered or taken into account that there will be an additional constriction on the flue gases passing through the heat exchanger.

Furthermore, while the inventive arrangements have been discussed in connection with oil-fired boilers, the same or similar modifications, features, characteristics, method steps and concepts also apply to gas-fired boilers, and especially those with power burners that positively create the required draft with a powered blower.

With the teachings of the present application, a person of ordinary skill in the art is able to convert an existing "old-fashioned" relatively inefficient single-pass boiler to multi-pass operation with increased efficiency and decreased oil consumption. Thus, the owner of an older inefficient single-pass boiler is no longer faced with the dilemma of continuing to send money up the chimney in the form of wasted (uncaptured) heat value, or facing a high up-front capital expenditure to replace the old inefficient boiler with a new efficient multi-pass boiler. Instead, the homeowner can keep the old and serviceable yet inefficient single-pass boiler, and convert it to more-efficient multi-pass operation.

As mentioned above, the front sectional view of FIG. 3 clearly shows the angled or sloping arrangement of the two stops 35' of RCF board material that are propped in the rear heat exchanger chamber 5" to hold the bottom portion of the diverting target wall 6' in place as discussed in connection with FIG. 2. FIG. 3 also clearly shows the heat exchange pins 18 in the flue passage 11B, as well as showing a front view of the components 31' and 32' of the upper draft diverter 30' in place in the flue collector chamber 12. Also visible in FIG. 3 is a water chamber 24 provided to receive an optional tankless water heater coil.

While the inventive modifications have been described above in connection with a four-section cast iron sectional boiler as shown in FIGS. 1, 2 and 3, the same or similar inventive components, features, method steps and concepts can be employed for improving the efficiency of other types, configurations and constructions of boilers as well. For example, this has been demonstrated with regard to a seven-section cast iron boiler as will be discussed next with regard to FIG. 4. Furthermore, this is also true for various configurations of steel plate boilers, stainless steel boilers, water tube boilers, spiral flue boilers, and the like. In each situation, it is simply necessary to fabricate and install suitable draft diverters at appropriate locations within the boiler so as to divert the original single-pass flue gas flow into a multi-pass flow through various flue passages of the heat exchanger.

Figure 4:
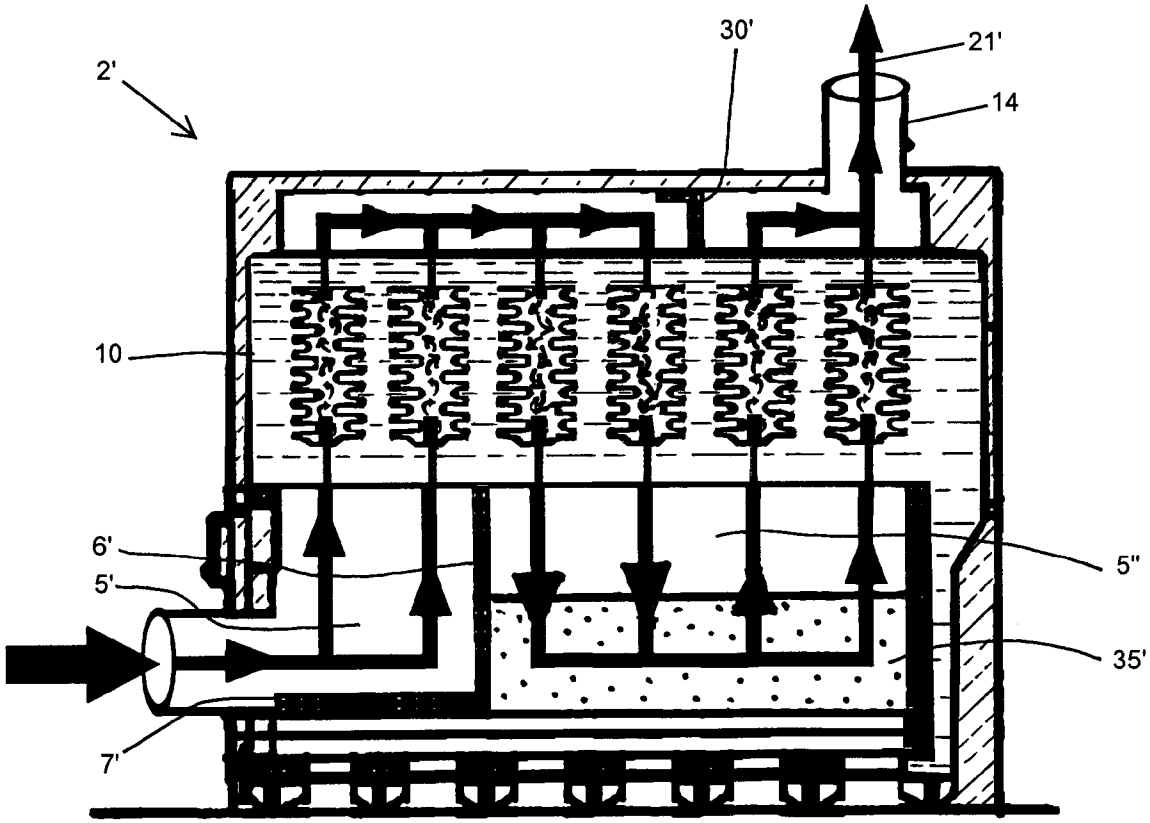
FIG. 4 is a schematic sectional side view similar to that of FIG. 2, but showing a seven-section cast iron boiler that has been modified according to one embodiment of the invention for multi-pass rather than single-pass flue gas flow through the heat exchanger.

FIG. 4 is a sectional side view similar to that of FIG. 2, but showing a different larger inventively modified boiler 2'. Namely, the boiler 2' in FIG. 4 is a seven-section cast iron boiler, in comparison to the four-section boiler 1' of FIG. 2. The seven-section boiler 2' is generally similar to the four-section boiler 1', except for the addition of three more intermediate sections of the boiler chassis and heat exchanger 10 to construct a longer boiler with a higher heat output capacity. The boiler 2' also started out as a conventional boiler, but was modified in accordance with the invention. The illustration of FIG. 4 has been simplified by omitting the burner unit, water return fitting, water supply fitting, etc., but any omitted features are similar to those described above in connection with FIGS. 1 and 2. Also, the front sectional view of the boiler 2' is similar to that shown in FIG. 3. Just as in the modified boiler 1', the modified boiler 2' has been outfitted with draft diverting components including a diverting target wall 6' and an upper draft diverter 30' similarly as described above.

However, as shown in FIG. 4, the larger seven-section boiler 2' has a total of six flue passages through the heat exchanger 10. This allows the draft diverting components 6' and 30' to be arranged in positions so as to produce a diverted flue gas flow pattern through two adjacent flue passages in parallel to each other, first upwardly through the heat exchanger 10, then back downwardly through the heat exchanger 10, and then again upwardly through the heat exchanger 10 to be discharged as exhaust gas 21' through the flue outlet 14. Namely, the flue gas flows through respective pairs of flue gas passages in parallel with one another, and in series through three of such pairs of flue gas passages in succession. The arrows schematically illustrate the hot flue gas flow pattern. Because the gas flow pattern always includes two flue passages parallel to one another, therefore, the arrangement in the boiler 2' according to FIG. 4 allows about twice as much flue gas flow as the arrangement in the boiler 1' of FIG. 2. Accordingly, the boiler 2' allows roughly twice the oil firing rate and twice the heat output of the boiler 1'. Such an arrangement with two parallel flue passages for each pass through the heat exchanger 10 is also necessary to maintain a sufficiently high oil firing rate and combustion rate to achieve the required heat output of the larger seven-section boiler. In other words, it would generally not be possible to divert the flow of flue gas from the original single pass configuration through six flue passages, down to six passes through a single flue passage at a time, because the single flue passage would be too small a constriction.

It should further be understood, while not illustrated, that other smaller or larger boilers can also be outfitted with the flue gas diverting components and other modifications according to the invention, in a similar manner as in the boilers 1' and 2' discussed above. For example, a ten section boiler with nine flue passages can be outfitted with draft diverters to achieve a three-pass flue gas flow, respectively through three flue passages at a time, namely the flue gas flowing upwardly through three flue passages, followed by flowing downwardly through three flue passages, and then finally flowing upwardly through the last three flue passages. It is also not absolutely necessary that each pass through the heat exchanger must use the same number of flue passages. For example, in a six section boiler with a total of five flue passages, the draft diverters can be arranged to use the first two flue passages for upflow through the heat exchanger, followed by a single flue passage providing downflow through the heat exchanger, followed by an upflow through the last two flue passages. In such an arrangement, a bypass hole or gap is provided in the diverting target wall 6' and in the upper draft diverter 30' (as discussed above) to allow a bypass flow though these diverters, so that some of the flue gas does not follow the multi-pass circuit through the heat exchanger, but rather makes only a single pass through the heat exchanger. For example, about two thirds (⅔) of the combustion gas is diverted upwardly through the first two flue passages while about one third (⅓) of the combustion gas bypasses through the bypass hole in the diverting target wall 6'. Then, one third (⅓) of the combustion gas is diverted downwardly through the third flue passage while one third bypasses through the bypass hole in the upper draft diverter 30'. Finally, the downwardly diverted ⅓ and the ⅓ of the combustion gas diverted through the target wall 6' pass upwardly through the last two flue passages, and are then joined by the ⅓ of combustion gas that was diverted through the upper draft diverter 30'. Depending on the required firing rate, the required overfire draft, the number of flue passages, etc., various different positions and arrangements of draft diverting components are possible. For example, it is also possible to provide additional draft diverters in the heat exchange chamber 5' and/or in the flue collector chamber 12, in order to create a five-pass flow pattern through the heat exchanger 10, rather than the illustrated three-pass flow pattern. However, generally the three-pass flow pattern is preferred, because a higher number of passes through the heat exchanger may result in too great a constriction on the flue gas flow in most applications.

The inventive modifications disclosed herein have been experimentally provided and tested in at least four different boilers using different brands of burners (including Carlin, Beckett, and Riello brand burners). Example test data of the combustion and efficiency parameters of two of the test units, before and after installing the inventive modifications, are as follows.

TEST UNIT #1: Memco SS Four-Section Boiler

Before installing inventive modifications:

Single-pass flue gas flow path through three heat exchanger flue passages in parallel 0.85×80 nozzle at 100 psi oil pressure Unit has powered draft induction Draft at breech −0.04 w.c.

Draft over fire −0.02 w.c.

Zero smoke on Bacharach scale

12% $CO_2$

Gross temperature at breech 469° F.

Net temperature at breech 400° F.

AFUE 83¾% efficiency

After installing inventive modifications:

Three-pass flue gas flow path through three heat exchanger flue passages in series 0.85×45 nozzle at 150 psi oil pressure Unit has powered draft induction Draft at breech −0.04 w.c.

Draft over fire −0.02 w.c.

Zero smoke on Bacharach scale 12.5% $CO_2$

Gross temperature at breech 335° F.

Net temperature at breech 260° F.

AFUE 87½% efficiency.

TEST UNIT #2: Peerless JOWT Four-Section Boiler

Before installing inventive modifications:

Single-pass flue gas flow path through three heat exchanger flue passages in parallel 0.85×80 nozzle at 140 psi oil pressure Unit has natural draft with chimney Draft at breech −0.03 w.c.

Draft over fire −0.01 w.c.

Zero smoke on Bacharach scale

12% $CO_2$

Gross temperature at breech 455° F.

Net temperature at breech 390° F.

AFUE 83¾% efficiency

After installing inventive modifications:

Three-pass flue gas flow path through three heat exchanger flue passages in series 0.85×45 (or ×60) nozzle at 150 psi oil pressure Unit has natural draft with chimney Draft at breech −0.01 w.c.

Draft over fire +0.02 w.c.

Trace smoke on Bacharach scale

12% $CO_2$

Gross temperature at breech 340° F.

Net temperature at breech 270° F.

AFUE 86¾% (to 87¼%) efficiency

Note: Loss of negative draft over fire and trace of smoke in exhaust are not acceptable and must still be corrected through further adjustments and/or by providing powered draft induction and/or a pressure fired burner and/or an insulated stainless steel chimney liner to keep the chimney warmer and smoother-flowing and thus to improve the natural draft.

Other test results have generally shown that typical existing four-section single-pass boilers are operating with a gross breech temperature of about 450° F. or higher, with 11 to 12% $CO_2$ in the exhaust gas, achieving an AFUE efficiency of 83 to 85%. After installing the inventive modifications and making the associated adjustments, these boilers are found to operate with a gross breech temperature of 322 to 355° F., with about 12 to 12.5% $CO_2$ in the exhaust gas, achieving an AFUE efficiency of at least 86%. The lower temperature exhaust gas and the associated higher efficiency means fuel savings and thus cost savings for the owner or operator of the boiler.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. A system for converting an existing single-pass boiler to a multi-pass boiler in which flue gas flows in multiple passes through a heat exchanger of the boiler, comprising a diverting target wall installed in a combustion chamber of the boiler partway along a length of the combustion chamber below the heat exchanger, and an upper draft diverter installed in an upper flue collector chamber above the heat exchanger, wherein the heat exchanger includes plural flue passages that each respectively communicate entirely through the heat exchanger between the combustion chamber and the upper flue collector, and wherein the diverting target wall and the upper draft diverter are configured, positioned and installed to be effective to divert at least a portion of flue gas resulting from combustion in the combustion chamber to flow in a multi-pass flow pattern in series upwardly through one of the flue passages from the combustion chamber entirely through the heat exchanger to the upper flue collector chamber, then downwardly through another one of the flue passages from the upper flue collector chamber entirely through the heat exchanger to the combustion chamber, and then upwardly through a further one of the flue passages from the combustion chamber entirely through the heat exchanger to the upper flue collector chamber.

2. A boiler conversion system for a previously existing single-pass boiler that has a combustion chamber, a flue collector chamber, and a heat exchanger with at least three flue passages that each communicate entirely through said heat exchanger between said combustion chamber and said flue collector chamber so that respective portions of flue gas resulting from combustion of fuel in said combustion chamber would each flow respectively in a single pass through respective ones of said flue passages from said combustion chamber to said flue collector chamber in a previously existing single-pass configuration of said boiler, wherein said boiler conversion system is for converting said previously existing single-pass boiler to a multi-pass boiler in which at least some of said flue gas flows in multiple passes including a first pass, a second pass and a third pass through said heat exchanger, and wherein said boiler conversion system comprises diverting components including:

a diverting target wall installed in said combustion chamber partway along a length of said combustion chamber so as to divert at least a majority of said flue gas to flow as a first flue gas flow from a first portion of said combustion chamber in front of said diverting target wall entirely through said heat exchanger to said flue collector chamber, in said first pass through said heat exchanger in at least one first flue passage among said flue passages of said heat exchanger; and a draft diverter installed in said flue collector chamber partway along a length of said flue collector chamber so as to divert at least a majority of said first flue gas flow to flow as a second flue gas flow from a first portion of said flue collector chamber in front of said draft diverter entirely through said heat exchanger to a rear portion of said combustion chamber behind said diverting target wall, in said second pass through said heat exchanger in at least one second flue passage among said flue passages of said heat exchanger;

wherein said diverting components are configured and arranged such that at least a majority of said second flue gas flow then flows as a third flue gas flow from said rear portion of said combustion chamber entirely through said heat exchanger to a second portion of said flue collector chamber behind said draft diverter, in said third pass through said heat exchanger in at least one third flue passage among said flue passages of said heat exchanger.

3. The boiler conversion system according to claim 2, wherein said boiler further comprises a flue gas outlet communicating out of said second portion of said flue collector chamber.

4. The boiler conversion system according to claim 2, wherein said first flue gas flow includes at least essentially all of said flue gas, said second flue gas flow includes at least essentially all of said first flue gas flow, and said third flue gas flow includes at least essentially all of said second flue gas flow.

5. The boiler conversion system according to claim 2, wherein said boiler has a total of exactly three of said flue passages, said at least one first flue passage consists of exactly one first flue passage, said at least one second flue passage consists of exactly one second flue passage, and said at least one third flue passage consists of exactly one third flue passage.

6. The boiler conversion system according to claim 2, wherein said boiler has a total of exactly six of said flue passages, said at least one first flue passage consists of exactly two first flue passages, said at least one second flue passage consists of exactly two second flue passages, and said at least one third flue passage consists of exactly two third flue passages.

7. The boiler conversion system according to claim 2, wherein said diverting target wall has an opening therein configured and adapted to allow a minority portion of said flue gas to flow through said opening into said rear portion of said combustion chamber and there join said second flue gas flow.

8. The boiler conversion system according to claim 2, wherein said draft diverter has an opening therein configured and adapted to allow a minority portion of said first flue gas flow to flow through said opening into said second portion of said flue collector chamber and there join said third flue gas flow.

9. The boiler conversion system according to claim 2, wherein said diverting target wall and said draft diverter are imperforate and sealed to prevent any significant amount of said flue gas from flowing past said diverting target wall and said draft diverter respectively.

10. The boiler conversion system according to claim 2, wherein said at least one first flue passage consists of exactly two first flue passages, and said at least one second flue passage consists of exactly one second flue passage.

11. The boiler conversion system according to claim 2, wherein said combustion chamber and said flue collector chamber each extend horizontally, wherein said flue passages each extend vertically, and wherein said diverting target wall and said draft diverter are arranged and adapted so that said first flue gas flow will flow upwardly through said at least one first flue passage, said second flue gas flow will flow downwardly through said at least one second flue passage, and said third flue gas flow will flow upwardly through said at least one third flue passage.

12. The boiler conversion system according to claim 2, wherein said diverting target wall is installed impermanently into said combustion chamber and said draft diverter is installed impermanently into said flue collector chamber by respectively being dimensioned and configured to fit and engage therein and being fitted and engaged therein.

13. The boiler conversion system according to claim 2, further comprising at least one support member to be wedged or braced into said combustion chamber behind said diverting target wall so as to support said diverting target wall.

14. The boiler conversion system according to claim 2, wherein said boiler, after said converting, has no refractory target wall and no refractory lining covering metal walls of said rear portion of said combustion chamber behind said diverting target wall.

15. The boiler conversion system according to claim 2, wherein said diverting target wall and said draft diverter are made of refractory ceramic fiber board or blanket.

16. The boiler conversion system according to claim 15, wherein said refractory ceramic fiber board or blanket is pre-cut to fit a sectional shape of said combustion chamber to fabricate said diverting target wall or to fit a sectional shape of said flue collector chamber to fabricate said draft diverter.

17. The boiler conversion system according to claim 15, wherein said refractory ceramic fiber board or blanket is not pre-cut to fit and is larger than a sectional shape of said combustion chamber or said flue collector chamber respectively, and said boiler conversion system further includes templates or instructions to cut said refractory ceramic fiber board or blanket to fit said sectional shape of said combustion chamber or said flue collector chamber.

18. A boiler conversion method for a previously existing single-pass boiler that has a combustion chamber, a flue collector chamber, and a heat exchanger with at least three flue passages that each communicate between said combustion chamber and said flue collector chamber so that respective portions of flue gas resulting from combustion of fuel in said combustion chamber would each flow respectively in a single pass through respective ones of said flue passages from said combustion chamber to said flue collector chamber in a previously existing single-pass configuration of said boiler, wherein said boiler conversion method is for converting said previously existing single-pass boiler to a multi-pass boiler in which at least some of said flue gas flows in multiple passes including a first pass, a second pass and a third pass through said heat exchanger, and wherein said boiler conversion method comprises installing diverting components including:

installing a diverting target wall in said combustion chamber partway along a length of said combustion chamber so as to divert at least a majority of said flue gas to flow as a first flue gas flow from a first portion of said combustion chamber in front of said diverting target wall to said flue collector chamber in said first pass through said heat exchanger in at least one first flue passage among said flue passages of said heat exchanger; and installing a draft diverter in said flue collector chamber partway along a length of said flue collector chamber so as to divert at least a majority of said first flue gas flow to flow as a second flue gas flow from a first portion of said flue collector chamber in front of said draft diverter to a rear portion of said combustion chamber behind said diverting target wall in said second pass through said heat exchanger in at least one second flue passage among said flue passages of said heat exchanger;

wherein said diverting components are configured and arranged such that at least a majority of said second flue gas flow then flows as a third flue gas flow from said rear portion of said combustion chamber to a second portion of said flue collector chamber behind said draft diverter in said third pass through said heat exchanger in at least one third flue passage among said flue passages of said heat exchanger.

19. The boiler conversion method according to claim 18, further comprising removing a refractory material target wall and a refractory material lining from metal walls of said rear portion of said combustion chamber.

20. The boiler conversion method according to claim 18, further comprising making said diverting target wall and said draft diverter imperforate and sealed in said combustion chamber and said flue collector chamber respectively so that all of said flue gas flows successively in series through said at least one first flue passage, then through said at least one second flue passage, and then through said at least one third flue passage.

* * * * *